United States Patent [19]

Kuersteiner

[11] Patent Number: 4,733,421

[45] Date of Patent: Mar. 29, 1988

[54] MASSAGING AND WASHING APPARATUS FOR PEOPLE

[75] Inventor: Hans Kuersteiner, Gais, Switzerland

[73] Assignee: Verena Kuersteiner, Gais, Switzerland

[21] Appl. No.: 870,203

[22] Filed: Jun. 2, 1986

[30] Foreign Application Priority Data

Nov. 22, 1985 [CH] Switzerland ..... 4989/85

[51] Int. Cl.[4] ..... A46B 13/02; A61H 7/00

[52] U.S. Cl. ..... 15/21 D; 4/535; 4/606; 128/56

[58] Field of Search ..... 15/21 D, 21 E, 97 R, 15/302, 53 A, 53 AB; 4/535, 606; 128/56, 62 R

[56] References Cited

U.S. PATENT DOCUMENTS

| | | | |
|---|---|---|---|
| 2,657,685 | 11/1953 | Holland | 4/606 X |
| 2,876,765 | 3/1959 | Day | 15/21 D X |
| 3,091,776 | 6/1963 | Roberts | 15/21 D |
| 3,862,459 | 1/1975 | Brunette | 15/21 D |
| 4,008,503 | 2/1977 | Tharp | 15/21 D |

*Primary Examiner*—Edward L. Roberts

*Attorney, Agent, or Firm*—Flynn, Thiel, Boutell & Tanis

[57] ABSTRACT

The apparatus consists of a vertically upright rotatable brush roller (4) arranged in an outwardly opening groove (5) of a water-tight housing (3). An arcuate water supply pipe (14) with plural water nozzles (15) is provided above the upper peripheral edge of the roller. The periphery of the roller projects from the groove. The side edges of the groove are provided with air-jet nozzles (16) which are directed tangentially to the roller. A standing against the brush roller (4) permits a washing and/or massaging of the human body, whereby the washing process is aided by a curtain of water created by the water supply to the water pipe (14) having plural downwardly directed water nozzles (15). An acceleration of the drying process is enhanced by the air-jet nozzles (16). The brush roller (4) is equipped with nylon bristles.

11 Claims, 5 Drawing Figures

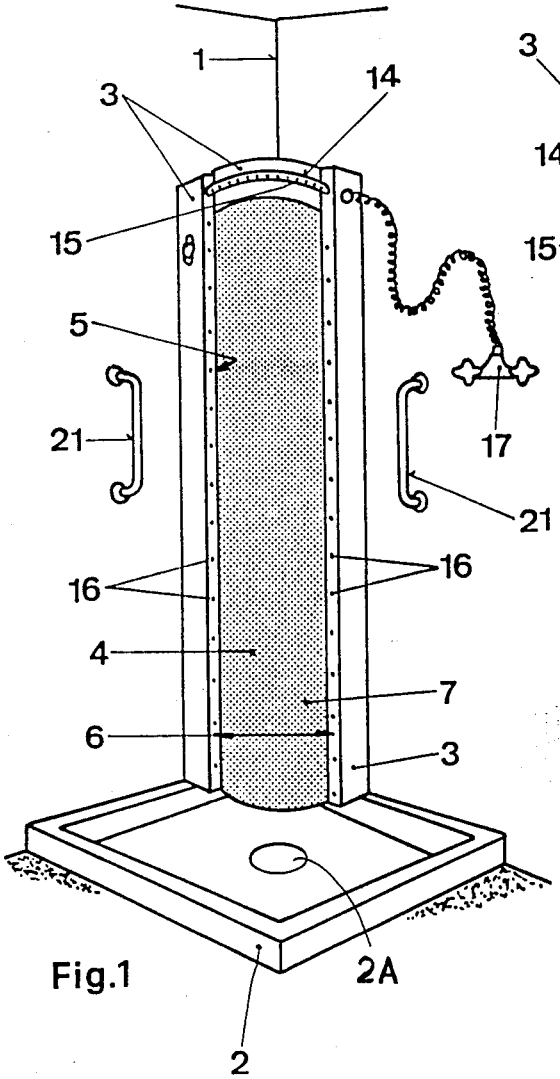
Fig.1
Fig.3
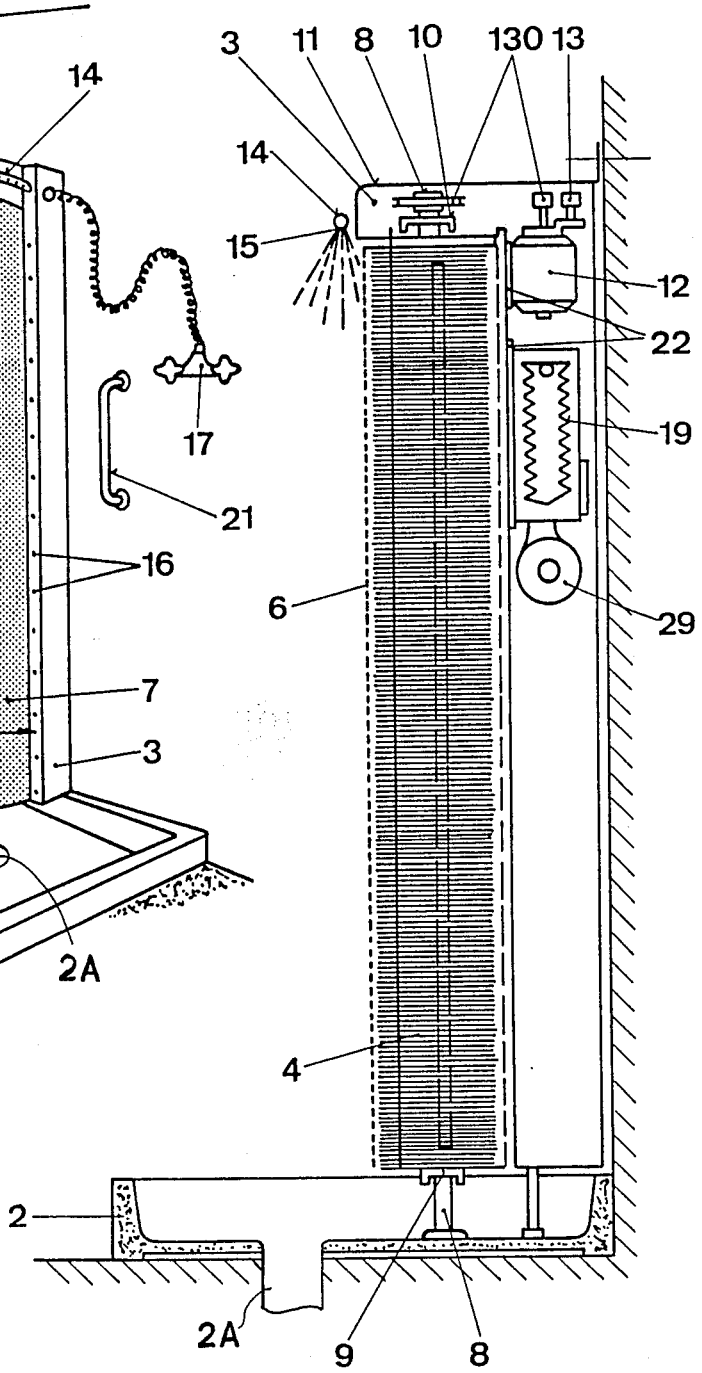

MASSAGING AND WASHING APPARATUS FOR PEOPLE

FIELD OF THE INVENTION

This invention relates to a massaging and washing apparatus and, more particularly, to a rotating brush apparatus against which the user rubs.

BACKGROUND OF THE INVENTION

Showers in bathrooms or washing and showering systems in sports centers, hospitals and nursing homes are known It is very difficult to clean certain parts of the body, for example the back, especially when the muscles are stiff—even when using brushes with long handles—due to the many complicated turning and twisting body movements required to perform the task.

The goal of the invention is to provide an auxiliary apparatus which facilitates a washing of the entire body, while simultaneously being usable for massaging purposes.

This goal is attained with an apparatus having a vertically upright rotating brush roller in which the person moves into engagement with and turns in front of the brush roller for washing or massaging purposes, so that the tips of the rotating brush elements slide over the entire body.

It is preferable to mount the drive parts in a hollow water-tight sleeve and the roller brush near an outside wall of the sleeve, preferably in an outwardly opening groove in the sleeve. Above the brush roller and mainly along a portion of the upper edge of its outer periphery, there are arranged water-supplying members, while above its entire height and tangentially to its periphery there can be arranged jet nozzles for heated air for the purpose of accelerating the drying process.

The apparatus can be provided with control members for controlling the rotational speed of the brush roller and with valves and mixing valves for supplying of a variable temperatured water or air. A dry or moist whole body massage with a simultaneous cleaning and care is possible with the apparatus.

The bristles of the brush roller consist of plastic material, preferably nylon, which has proven to be very durable and hygienic, in particular with regard to the resistance to the growth of bacteria or the formation of fungi.

BRIEF DESCRIPTION OF THE DRAWINGS

One exemplary embodiment of an inventive apparatus is illustrated in the drawings, in which:

FIG. 1 is a perspective view of a massaging and washing apparatus for people, which apparatus is arranged in a corner of a room;

FIG. 3 is a vertical diagonal cross-sectional view taken along the line III—III of FIG. 2 in a larger scale;

DETAILED DESCRIPTION

Figure 2:
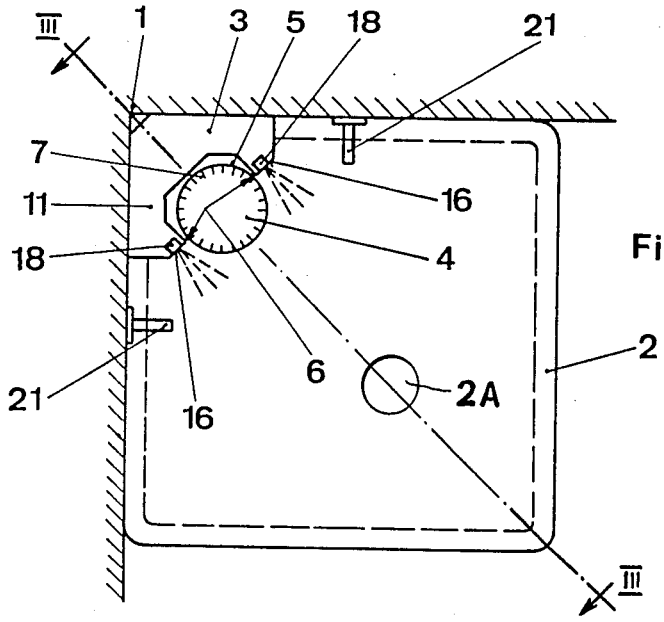
FIG. 2 is a top view of the apparatus in a reduced scale.
Figure 4:
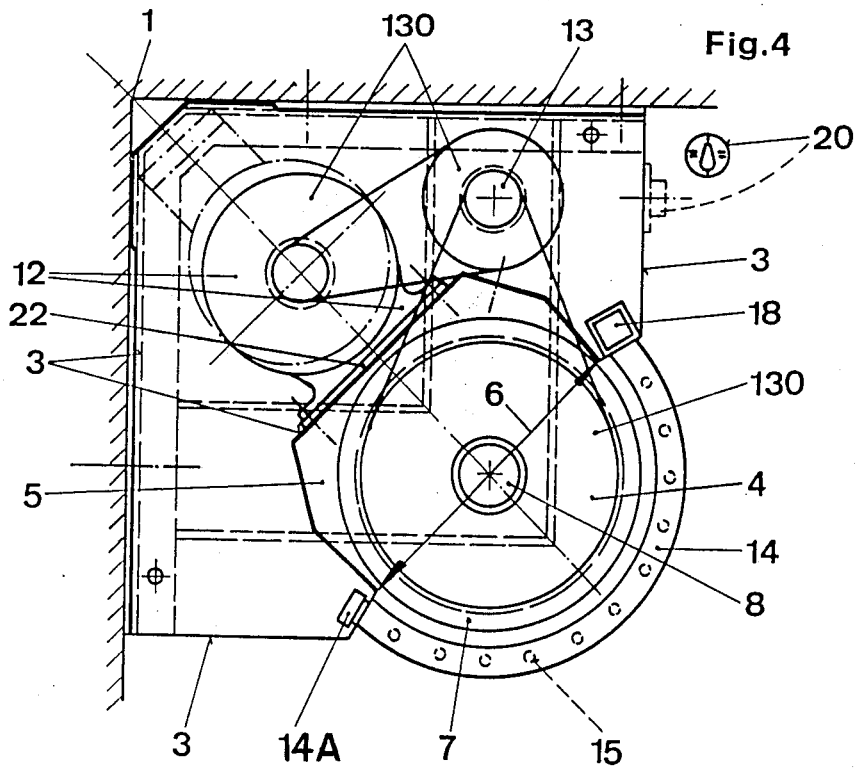
FIG. 4 is a top view of the apparatus and the operating members.

A shower stall 2 having a conventional drain 2A, which serves as a catch basin for water, is arranged in a corner 1 of a bathroom. The corner part has provided therein an upstanding, generally C-shaped, hollow water-tight sleeve 3, which serves as a housing for an elongated brush roller 4 and the drive parts therefor. The sleeve 3 has an elongated outwardly opening generally semi-cylindrical groove 5 therein into which is received the brush roller sleeve. The arcuate space between the vertically upright edges 6 of the groove 5 in the sleeve 3 frees the roller circumference in a range of 90° to 240°. The user of the apparatus can come into contact with the bristles 7 of the brush roller 4 between the upright edges 6.

The brush roller 4 has a central axle 8. The lower end of the axle 8 is rotatably supported by a bearing 9 on the floor of the shower stall 2. The upper end of the axle 8 is rotatably supported by a bearing 10 on an upper cover member 11 of the sleeve 3.

The two bearings 9 and 10 can be adjusted in height. An electric motor 12 serves as the drive member, from which motor, through reduction gearing operatively associated with the shaft 13 and the drive pulley 130, the axle 8 of the brush roller 4 is driven. The drive parts, that is the motor 12 and the reduction gearing 13, 130, are housed inside of the hollow sleeve and beneath the cover member 11 and thus are separated from the wet part of the apparatus.

Water is supplied to the brush roller 4 through a delivery pipe connection 14A to an arcuate water pipe 14, which extends above the arcuate free space between the edges 6. The center of the arc for the pipe 14 is coaxial with the axis of the axle 8. The pipe 14 is located adjacent the upper edge of the brush roller. The water pipe 14 has plural downwardly directed water nozzles 15 which produce a curtain of water in front of the brush roller. Air-jet nozzles 16 are arranged in the vertical edges of the recess or groove 5, which air-jet nozzles are fed from the inside of the hollow sleeve 3. The jet of air from each nozzle is directed approximately tangentially with respect to the circumference of the brush roller in the area of the edges 6.

The apparatus is completed with known control and auxiliary means, which are arranged partly within the hollow sleeve protected against water and partly outside of said sleeve. The components mounted outside of the sleeve 3 are the regulating valve 17 for the cold and warm water supply, a switch 20 for switching on and off the rotation of the brush roller 4 and a pair of handles 21. Inside the sleeve is provided an air supply pipe 18 and associated air heating element 19. For facilitating an electric grounding, the electric motor 12, which is arranged in the sleeve 3, the heating element 19 and a fan 29 are mounted on an insulating plate 22, just like the electric distributor connections, which are protected from moisture by a rubber seal.

Figure 5:
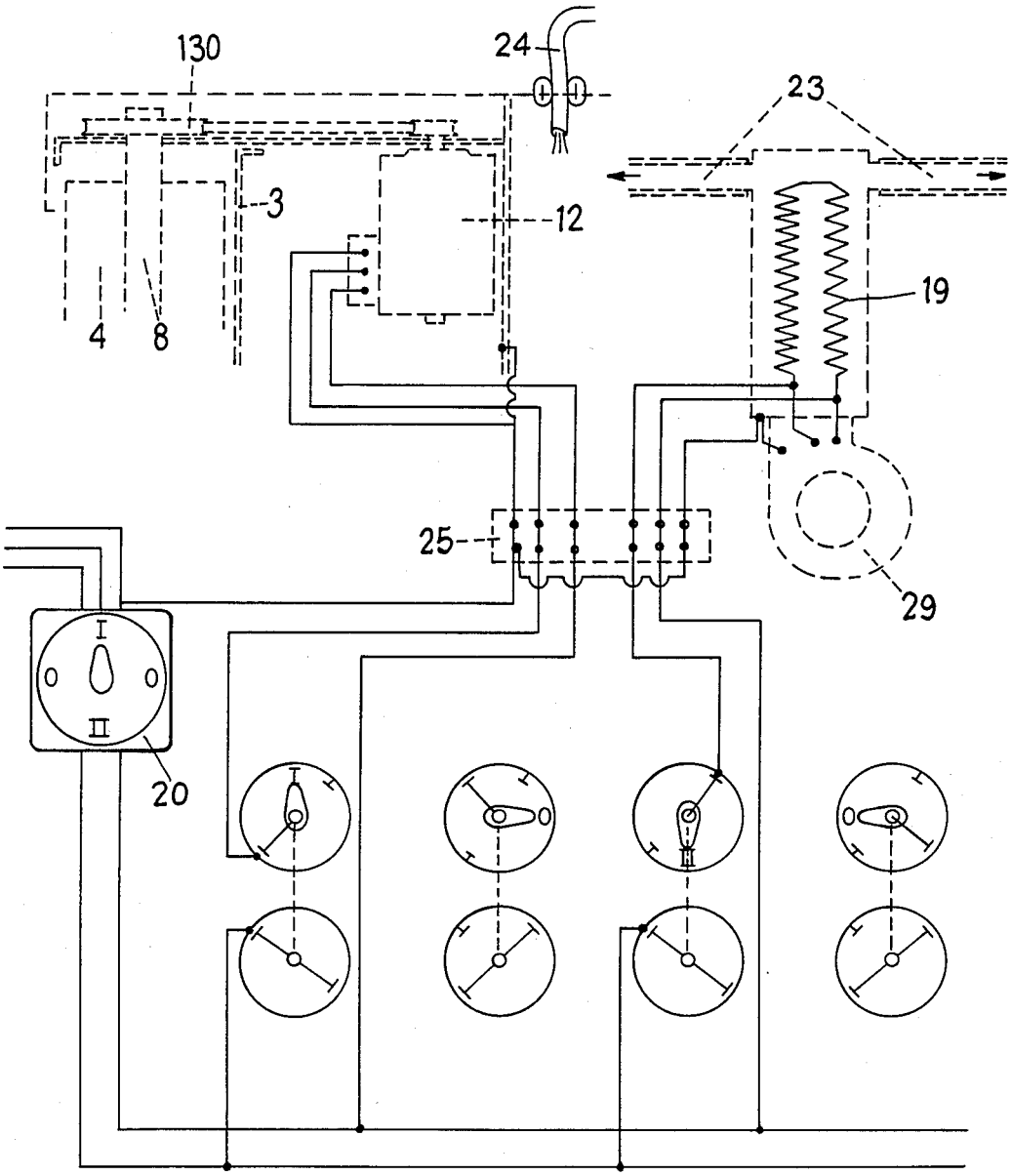
FIG. 5 is an electrical circuit diagram of the apparatus.

FIG. 5 schematically illustrates an electrical circuit diagram of the apparatus according to FIGS. 1 to 4. The brush roller 4 has on its axle 8 a drive pulley 130 which is coupled to the electric motor 12. Next to the drive motor 12 is the heating system with the heating elements 19 and the fan 29 from where the air is guided past the heating elements to the air supply pipe 23, and from there to the air-jet nozzles 16 arranged on both sides of the brush roller. The actual connection of the air supply pipe 23 to the pipe 18 is not illustrated. Reference numeral 3 identifies the sleeve which encloses the various operating parts and reference numeral 24 identifies the electric supply cable.

The electrical cables are connected so that from the main switch 20, in the switch position I, the electric motor is energized for the purpose of rotating the axle 8 and brush roller 4 or, in the switch position II, operating the fan 29 and the heating elements 19 for the purpose of drying by means of the spray of warm air through the nozzles 16.

All lines lead through a grounded and splash-water protected switchboard 25, which is preferably provided within the sleeve 3. The distributor terminals which are arranged on the switchboard can additionally be covered with a waterproof rubber hood.

According to the circuit diagram which is illustrated in FIG. 5, the electric motor is operated either in the switch position I, depending on the position of the switch which is arranged outside of the apparatus, for cleaning or massaging of the body, whereby cold or warm water is supplied or the warm air supply is activated with the switch position II. A simultaneous switching on of the drive motor 12 to effect a rotation of the brush roller and the heater 19 and the fan 29 to effect a delivery of warm air is not sensible.

The switchboard 25, insulating plate 22 and auxiliary aggregates as well as all metal and outer parts are grounded.

The brush bristles 7 of the roller can be manufactured of any desired material or may be of any desired hardness. Bristles made of nylon, which material is immune both to bacteria and also to the formation of fungus are, however, particularly suited.

Aside from cleaning the body, the apparatus can also be used for effecting a dry or wet massage, whereby the massaging effect can be varied by changing the speed of the roller. The drying process can be accelerated by means of the air-jet nozzles.

Since the apparatus fully and completely meets the hygienic requirements, it can also be used in community centers, for example in shower and wash rooms of sports centers, where the upstanding sleeve can stand freely in a room without the use of a shower stall.

The inventive massaging and washing apparatus can be connected directly to a already existing shower connection.

When installing the apparatus in a corner of a smaller room, the axis of rotation of the brush roller will lie preferably in the angle bisector of the built-in corner.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A people massaging and washing apparatus, comprising:

frame means and first support means for supporting said frame means on a supporting surface;

an elongated, cylindrical brush means and second support means for rotatably supporting said brush means about a vertically upright axis of rotation on said frame means;

drive means for driving said brush means for rotation; and water supply means on said frame means for supplying a curtain of water in an arcuate pattern that extends generally coaxially to said axis of rotation and generally parallel to a peripheral portion of said brush means along the length of said brush means.

2. The apparatus according to claim 1, wherein said frame means includes an upstanding, generally C-shaped housing enclosing a first portion of said cylindrical brush means, a second portion of said cylindrical brush means that is uncovered being in the range of 90° to 240° of the circumference of said brush means; and wherein said water supply means includes an arcuate supply pipe adjacent an upper end of said uncovered portion of said upstanding brush means and being mounted on said housing, said supply pipe having a plurality of arcuately spaced, downwardly directed water nozzles so that said arcuate curtain of water extends generally along the length of said brush means.

3. The apparatus according to claim 2, wherein said frame means includes an air-jet supply means for supplying a curtain of air extending horizontally outwardly in a direction generally away from opposing vertically upright side edges of said uncovered portion of said brush means as well as away from said brush means.

4. The apparatus according to claim 1, wherein said frame means includes an upstanding closed sleeve having a convex recess for receiving said brush means therein.

5. The apparatus according to claim 4, wherein in an area along the length of opposing vertically upright side edges of said recess there are arranged jet nozzles for facilitating the supply of air.

6. The apparatus according to claim 4, wherein said closed sleeve is arranged with a back wall opposite said recess flush against a corner of a room, said brush means being located on an angle bisector of the corner.

7. The apparatus according to claim 6, wherein between said drive means and said axis of rotation there is arranged a reduction gearing for effecting said rotational drive of said brush means, said drive means being arranged inside said sleeve and protected on all sides against moisture and wetness.

8. The apparatus according to claim 7, wherein said drive means is an electric motor, wherein a heating element, electric distributor terminals and a blower are mounted on an electric insulating plate which is provided inside of said sleeve.

9. The apparatus according to claim 6, wherein said sleeve is set up in a stall having a water-collecting basin.

10. The apparatus according to claim 1, wherein said brush means includes a brush member with radially outwardly extending bristles which consist of a plastic material for assuring a sterile environment and renders impossible the formation of fungi or bacteria thereon.

11. The apparatus according to claim 10, wherein said brush member is rotatably supported by an axle supported at opposite ends by ball bearings.

* * * * *